US010202728B1

(12) United States Patent
Li et al.

(10) Patent No.: US 10,202,728 B1
(45) Date of Patent: Feb. 12, 2019

(54) SLIDING GROOVE TYPE FRICTION PENDULUM HIGH-PIER BRIDGE SEISMIC MITIGATION AND ISOLATION BEARING

(71) Applicant: Sichuan University, Chengdu,Sichuan (CN)

(72) Inventors: Wenqiang Li, Sichuan (CN); Yudong Zhao, Sichuan (CN); Yan Li, Sichuan (CN); Fei Li, Sichuan (CN); Huaibang Han, Sichuan (CN); Song Li, Sichuan (CN); Renjie Ran, Sichuan (CN); Qiang Wang, Sichuan (CN)

(73) Assignee: Sichuan University, Chengdu (CN)

( * ) Notice: Subject to any disclaimer, the term of this patent is extended or adjusted under 35 U.S.C. 154(b) by 0 days.

(21) Appl. No.: 15/995,152

(22) Filed: Jun. 1, 2018

(30) Foreign Application Priority Data

Aug. 14, 2017 (CN) ..... 2017 1 0690853

(51) Int. Cl.
*E01D 19/04* (2006.01)

(52) U.S. Cl.
CPC ..... *E01D 19/042* (2013.01)

(58) Field of Classification Search
CPC ..... E01D 19/042; E02D 31/08
USPC ..... 14/73.5; 52/167.4
See application file for complete search history.

(56) References Cited

U.S. PATENT DOCUMENTS 3,806,975 A * 4/1974 Fyfe ..... E01D 19/047 14/73.5
4,259,759 A * 4/1981 Tada ..... E01D 19/046 14/73.5
6,725,612 B2 * 4/2004 Kim ..... E04H 9/023 52/167.1
8,484,911 B2 * 7/2013 Zayas ..... E04H 9/023 248/562
2004/0221520 A1 * 11/2004 Chiang ..... E04H 9/023 52/167.1
2018/0142434 A1 * 5/2018 Yu ..... E01D 19/04

FOREIGN PATENT DOCUMENTS

CN 2521285 Y 11/2002
CN 102787679 A 11/2012
CN 205152780 U 4/2016
(Continued)

*Primary Examiner* — Gary S Hartman
(74) *Attorney, Agent, or Firm* — Wayne & Ken, LLC

(57) ABSTRACT

A sliding groove type friction pendulum high-pier bridge seismic mitigation and an isolation bearing. The bearing includes an upper connecting steel plate, a lower connecting steel plate, and a frictional sliding component clamped between the upper connecting steel plate and the lower connecting steel plate. The frictional sliding component includes an upper bearing plate, a lower bearing plate, and a hyperbolic spheroid. The upper bearing plate and the lower bearing plate are disposed on corresponding connecting steel plates, and are mounted and cooperate by using a plurality of parallel protrusions and grooves. The hyperbolic spheroid is disposed between the upper bearing plate and the lower bearing plate. A plurality of hysteretic damping components, bearing positioning structures, butterfly-shaped spring components, and bearing limiting structures are disposed on opposite surfaces of the upper bearing plate and the lower bearing plate in a circumferential direction.

10 Claims, 7 Drawing Sheets

(56) References Cited

FOREIGN PATENT DOCUMENTS

| | | | |
|---|---|---|---|
| CN | 105971148 | A | 9/2016 |
| CN | 106012817 | A | 10/2016 |
| CN | 106592421 | A | 4/2017 |
| CN | 106835958 | A | 6/2017 |
| JP | 2006125503 | A | 5/2006 |
| JP | 2006328655 | A | 12/2006 |

* cited by examiner

SLIDING GROOVE TYPE FRICTION PENDULUM HIGH-PIER BRIDGE SEISMIC MITIGATION AND ISOLATION BEARING

FIELD OF THE INVENTION

The present invention pertains to the field of building and bridge structure technologies, and specifically, to a sliding groove type friction pendulum high-pier bridge seismic mitigation and isolation bearing.

BACKGROUND OF THE INVENTION

Earthquakes are sudden and devastating. Although an earthquake usually lasts for dozens of seconds, it causes a tremendous loss of life and property. This is unmatchable by other natural disasters. Examples of earthquakes are a magnitude 8.0 earthquake in Wenchuan in 2008 and a magnitude 7.1 earthquake in Yushu, Qinghai in 2010. Likewise, there are also records of similar terrible seismic disasters abroad, for example, a magnitude 8.9 earthquake off the coast of Honshu, Japan in 2011 and a magnitude 8.8 earthquake in Bio Bio Province, Chile, in 2010. Although people have made great progress in both seismic knowledge and engineering seismic resistance over recent decades, earthquakes still have caused horrible heavy losses and great casualties.

Bridge engineering is lifeline engineering. Seismic disasters at home and abroad show that, damage or collapse of a bridge in a seismic region not only hinders disaster relief actions at the time, but also affects restoration and reconstruction of the bridge after the disaster. A bridge bearing is an important component that connects a superstructure and a substructure of a bridge. The bridge bearing can reliably transfer stress, deformation, displacement, and rotation of the superstructure of the bridge to the substructure of the bridge. However, the bridge bearing is also a weakest part in bridge seismic resistance. Therefore, it is necessary to perform research and structural innovation with respect to the bridge bearing, and in particular, to a seismic mitigation and isolation bearing.

Currently, antiseismic apparatuses applied to engineering of buildings and bridges mainly include a lead rubber bearing, a polyurethane spring ball bearing, a planar frictional sliding bearing, and the like. These bearings have their own advantages, but still have some disadvantages in actual application processes. The lead rubber bearing has poor durability and a low bearing capacity, and may be aged easily. A rubber material becomes hard at a low temperature, and becomes soft and consumes less energy at a high temperature. In addition, lead in the lead rubber bearing may cause environmental pollution or the like. The polyurethane spring ball bearing has poor durability, and after yielding to external force, has little displacement. The planar frictional sliding bearing has poor pullout resistance or overturn resistance performance, has no restoration capability, and therefore, when applied, needs to cooperate with other types of bearings that have restoration force. In addition, although conventional bearings have seismic mitigation functions to some extent, few of the bearings have a structure that ensures that a bridge, a bearing, and a pier are always interconnected and prevents bridge falling during an earthquake. Currently, a method for solving bridge falling during an earthquake is to additionally configure an apparatus for preventing bridge falling. However, this causes a series of problems such as a huge structure and cost increase.

The present invention provides a sliding groove type friction pendulum high-pier bridge seismic mitigation and isolation bearing that is practical and perfect and can solve the foregoing problem.

SUMMARY OF THE INVENTION

Objectives of the present invention are to overcome disadvantages of the prior art and provide a sliding groove type friction pendulum high-pier bridge seismic mitigation and isolation bearing. The bearing satisfies normal use of building and bridge structures under normal working conditions. Under seismic working conditions, the bearing depends on a seismic mitigation and isolation apparatus formed by a hysteretic damping component, a bearing positioning structure, a butterfly-shaped spring component, and a bearing limiting structure. The bearing has seismic mitigation and isolation functions of a conventional bearing. In addition, the bearing is capable of preventing bridge falling, has a strong horizontal anti-shearing capability, and has functions of resetting and the like.

The objectives of the present invention are achieved by using the following technical solutions: A sliding groove type friction pendulum high-pier bridge seismic mitigation and isolation bearing includes an upper connecting steel plate, a lower connecting steel plate, and a frictional sliding component clamped between the upper connecting steel plate and the lower connecting steel plate, where a plurality of parallel protrusions are disposed on opposite surfaces of the upper connecting steel plate and the lower connecting steel plate, and the protrusions on the upper connecting steel plate are vertical to the protrusions on the lower connecting steel plate;

the frictional sliding component includes an upper bearing plate, a lower bearing plate, and a hyperbolic spheroid, the upper bearing plate is disposed on a lower surface of the upper connecting steel plate, the lower bearing plate is disposed on an upper surface of the lower connecting steel plate, grooves matching corresponding protrusions are provided on both the upper bearing plate and the lower bearing plate, and the hyperbolic spheroid is located between the upper bearing plate and the lower bearing plate and cooperates with the upper bearing plate and the lower bearing plate based on sliding of a spherical sliding friction pair; and a plurality of hysteretic damping components, a plurality of bearing positioning structures, a plurality of butterfly-shaped spring components, and a plurality of bearing limiting structures are disposed on opposite surfaces of the upper bearing plate and the lower bearing plate in a circumferential direction.

The hysteretic damping component includes two hysteretic dampers, the hysteretic damper includes a U-shaped frame and an oblique frame, the U-shaped frame is located in a horizontal plane, a slot bottom of the U-shaped frame is fixedly connected to one end of the oblique frame, the oblique frame is located in a vertical plane and disposed obliquely, oblique frames of the two hysteretic dampers overlap and clasp each other, and slot openings of the U-shaped frames of the two hysteretic dampers are respectively located in an upper position and a lower position.

The bearing positioning structure includes an upper positioning block and a lower positioning block, the upper positioning block is fixed on the upper bearing plate, the lower positioning block is fixed on the lower bearing plate, slotted holes are provided in a horizontal direction in middle positions in the upper positioning block and the lower positioning block, and a shearing bolt is disposed in the slotted holes to connect the upper positioning block and the lower positioning block.

The butterfly-shaped spring component includes a bushing, a butterfly-shaped spring, a mild steel core, and a button-shaped snap ring, blind holes are provided on the opposite surfaces of both the upper bearing plate and the lower bearing plate, a bushing matching the blinding hole is disposed in each blind hole, a rear bearing cushion is disposed at a bottom of each blind hole, the butterfly-shaped spring is disposed between two bushings, the mild steel core is disposed in an axial direction in a center of the butterfly-shaped spring, the button-shaped snap ring is disposed at a hole edge of the blind hole, one end of the bushing extends out of the blind hole, and the button-shaped snap ring is snapped onto the end of the bushing.

The bearing limiting structure includes an external limiting block and an internal limiting block, the external limiting block is fixed on the upper bearing plate, the internal limiting block is fixed on the lower bearing plate, the external limiting block and the internal limiting block are snapped onto each other, and a gap exists between the external limiting block and the internal limiting block.

The protrusions and the grooves have gaps in vertical and horizontal directions thereof, sizes of the gaps are different, and vertical gaps of the protrusions are greater than horizontal gaps.

Shapes of cross-sections of the protrusions on the upper connecting steel plate and the lower connecting steel plate in vertical planes are semi-circle arc shapes, semi-ellipse arc shapes, semi-triangle shapes, semi-rectangle shapes, semi-polygon shapes, or semi-non-polygon shapes.

The upper connecting steel plate is connected to a bridge by using an upper anchor pullout resistance component formed by a plurality of pillars, the lower connecting steel plate is connected to a pier by using a lower anchor pullout resistance component formed by a plurality of pillars, a shape of a bottom of the anchor pullout resistance component is a pillar shape, and a periphery of the pillar shape is a groove or inverted tooth structure.

A quantity of the hysteretic damping components is two, a quantity of the bearing positioning structures is two, a quantity of the butterfly-shaped spring components is two, and a quantity of the bearing limiting structures is two.

The spherical friction pair includes a spherical non-metal sliding plate and a spherical stainless steel plate, and the spherical non-metal sliding plate and the spherical stainless steel sliding plate are combined into the spherical friction pair.

Compared with the prior art, the present invention has the following advantages:

(1) Currently, research and design of various seismic mitigation apparatuses are mainly based on seismic mitigation purposes, and excessive relative displacement of a pier and a bridge due to a long-term nonlinear effect of a high pier is not considered in the design. The present invention uses a sliding groove type structure to effectively solve a problem of a cumulative effect caused by factors such as a temperature effect cycle and braking force.

(2) In use of a conventional hyperbolic spheroid friction pendulum bearing, a superstructure such as a bridge is subject to great vertical displacement or rotational displacement, and this has an extremely adverse impact on building and bridge structures under seismic working conditions. The butterfly-shaped spring component, hysteretic damping component, and bearing limiting structure used in the present invention, depending on their resilient restoration and hysteresis features during an earthquake, help reduce excessive displacement and rotation angles, and can absorb massive seismic energy. A seismic mitigation and isolation effective is very good.

(3) A conventional bearing uses a limiting screw or an anti-shearing bolt to limit a relative position of the bearing under normal working conditions. However, under seismic working conditions, after the anti-shearing bolt is cut off, the bearing cannot be restored to a normal position after an earthquake even if the earthquake is a low-magnitude earthquake. In the present invention, both the butterfly-shaped spring component and the hysteretic damping component can provide deformation and restoration for the bearing under seismic working conditions. This is of great significance for performance of the bearing in building and bridge engineering.

In the figures: 1—upper connecting steel plate, 2—upper bearing plate, 3—hysteretic damping component, 31—hysteretic damper, 4—lower bearing plate, 5—lower connecting steel plate, 6—bearing positioning structure, 61—upper positioning block, 62—lower positioning block, 7—hyperbolic spheroid, 8—butterfly-shaped spring component, 81—bushing, 82—butterfly-shaped spring, 83—mild steel core, 84—button-shaped snap ring, 85—bearing cushion, 86—blind hole, 9—bearing limiting structure, 91—external limiting block, and 92—internal limiting block.

DETAILED DESCRIPTION OF THE INVENTION

The following further describes the present invention with reference to the accompanying drawings. However, the protection scope of the present invention is not limited thereto.

Figure 1:
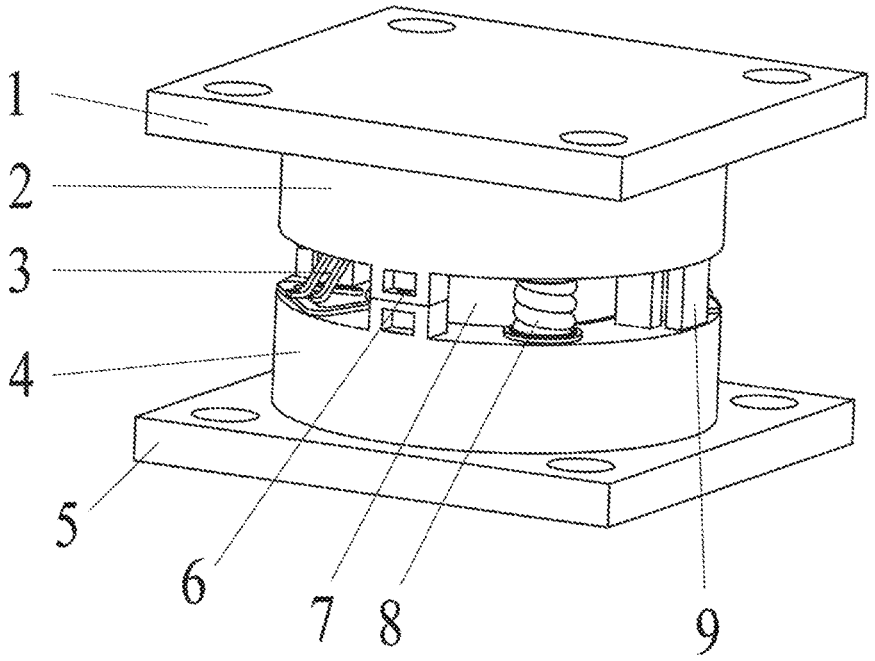
FIG. 1 is a schematic structural diagram of the present invention.

As shown in FIG. 1, a sliding groove type friction pendulum high-pier bridge seismic mitigation and isolation bearing includes an upper connecting steel plate 1, a lower connecting steel plate 5, and a frictional sliding component clamped between the upper connecting steel plate 1 and the lower connecting steel plate 5. The sliding groove type friction pendulum high-pier bridge seismic mitigation and isolation bearing further includes a hysteretic damping component 3, a bearing positioning structure 6, a butterfly-shaped spring component 8, and a bearing limiting structure 9.

Figure 2:
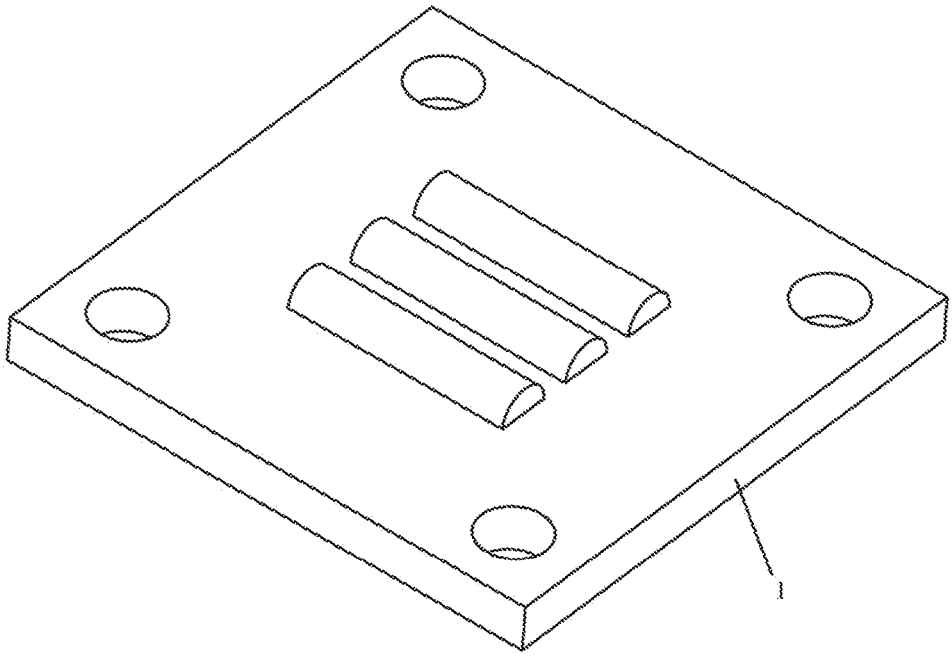
FIG. 2 is a schematic structural diagram of a lower end face of an upper connecting steel plate.

As shown in FIG. 2, a lower end face of the upper connecting steel plate 1 includes several parallel protrusions, an upper end face of the lower connecting steel plate 5 includes several parallel protrusions, and the protrusions on the lower end face of the upper connecting steel plate 1 and the upper end face of the lower connecting steel plate 5 are disposed and staged by 90 degrees, that is, the protrusions on the lower surface of the upper connecting steel plate 1 are vertical to the protrusions on the upper surface of the lower connecting steel plate 5. Shapes of cross-sections of the protrusions on the lower end face of the upper connecting steel plate 1 and the upper end face of the lower connecting steel plate 5 in vertical planes are semi-circle arc shapes, or may be semi-ellipse arc shapes, semi-triangle shapes, semi-rectangle shapes, semi-polygon shapes, or semi-non-polygon shapes. The upper connecting steel plate 1 is connected to a bridge by using an upper anchor pullout resistance component formed by a plurality of pillars, the lower connecting steel plate 5 is connected to a pier by using a lower anchor pullout resistance component formed by a plurality of pillars, a shape of a bottom of the anchor pullout resistance component is a pillar shape, and a periphery of the pillar shape is a groove or inverted tooth structure.

Figure 3:
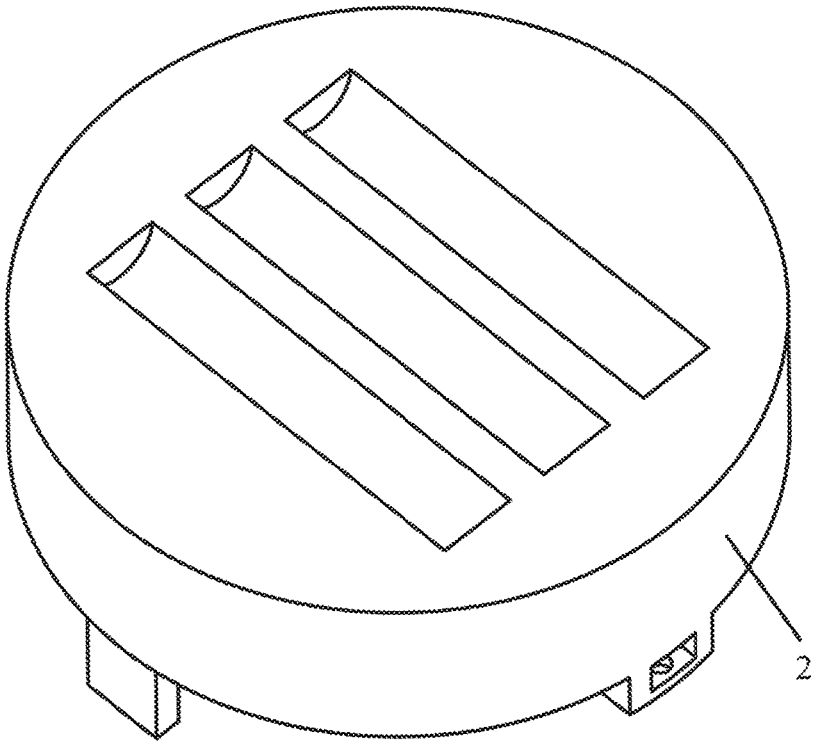
FIG. 3 is a schematic structural diagram of an upper end face of an upper bearing plate.
Figure 4:
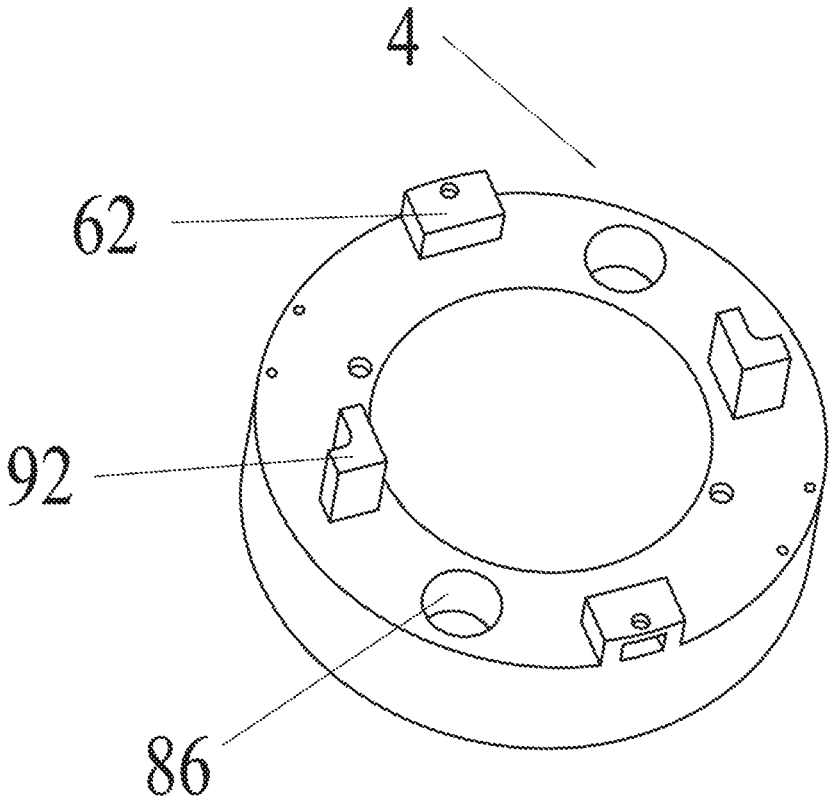
FIG. 4 is a schematic structural diagram of a lower end face of an upper bearing plate.
Figure 5:
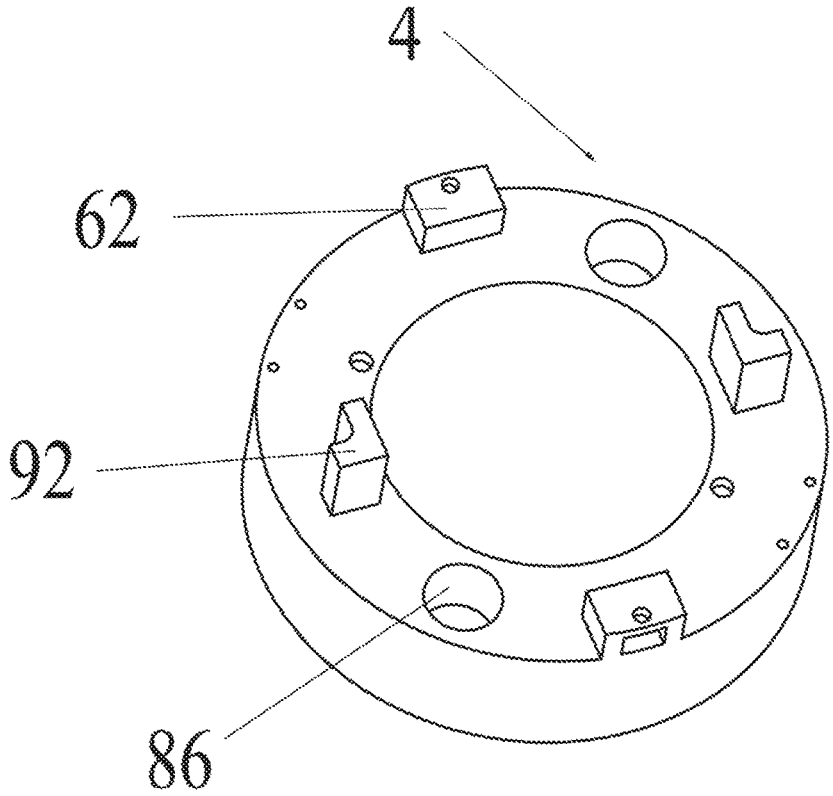
FIG. 5 is a schematic structural diagram of an upper end face of a lower bearing plate.

As shown in FIG. 3, FIG. 4, and FIG. 5, the frictional sliding component includes an upper bearing plate 2, a lower bearing plate 4, and a hyperbolic spheroid 7, the upper bearing plate 2 is disposed on the lower surface of the upper connecting steel plate 1, and the lower bearing plate 4 is disposed on the upper surface of the lower connecting steel plate 5. An upper end face of the upper bearing plate 2 includes several parallel grooves, and the grooves match the protrusions on the upper connecting steel plate 1. A lower end face of the lower bearing plate 4 includes several parallel grooves, and the grooves match the protrusions on the lower connecting steel plate 5. The protrusions and the grooves have gaps in vertical and horizontal directions thereof, sizes of the gaps are different, and vertical gaps of the protrusions are greater than horizontal gaps. The hyperbolic spheroid 7 is clamped between the upper bearing plate 2 and the lower bearing plate 4 and cooperates with the upper bearing plate 2 and the lower bearing plate 4 based on sliding of a spherical sliding friction pair. The spherical sliding friction pair includes an upper spherical sliding friction pair and a lower spherical sliding friction pair. The upper spherical sliding friction pair includes a spherical non-metal sliding plate and a spherical stainless steel sliding plate. The lower spherical sliding friction pair includes a spherical non-metal sliding plate and a spherical stainless steel sliding plate.

Figure 7:
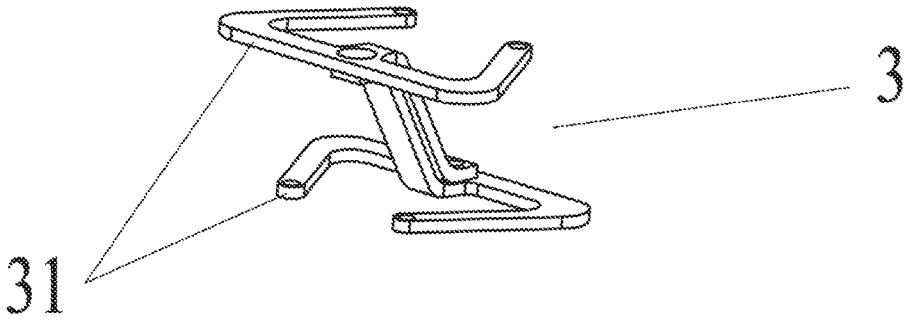
FIG. 7 is a schematic structural diagram of a hysteretic damping component.

As shown in FIG. 7, several groups of hysteretic damping components 3 used to bear bridge load, reduce rigidity of the bearing, prolong an earthquake period of a great earthquake, and provide restoration force and damping during the earthquake are disposed outside the hyperbolic spheroid 7 and between the upper bearing plate 2 and the lower bearing plate 4. The hysteretic damping component 3 includes two hysteretic dampers 31. The hysteretic damper 31 includes a U-shaped frame and an oblique frame, the U-shaped frame is located in a horizontal plane, a slot bottom of the U-shaped frame is fixedly connected to one end of the oblique frame, the oblique frame is located in a vertical plane and disposed obliquely, oblique frames of the two hysteretic dampers 31 overlap and clasp each other, and slot openings of the U-shaped frames of the two hysteretic dampers 31 are respectively located in an upper position and a lower position. The hysteretic dampers 31 are made of mild steel.

As shown in FIG. 1, several bearing positioning structures 6 used to bear bridge load and fix relative positions of the upper bearing plate 2 and the lower bearing plate 4 by using shearing bolts under normal working conditions are disposed outside the hyperbolic spheroid 7 and between the upper bearing plate 2 and the lower bearing plate 4. The bearing positioning structure 6 includes an upper positioning block 61 and a lower positioning block 62, the upper positioning block 61 is fixed on the upper bearing plate 2, the lower positioning block 62 is fixed on the lower bearing plate 4, slotted holes are provided in a horizontal direction in middle positions in the upper positioning block 61 and the lower positioning block 62, and a shearing bolt is disposed in the slotted holes to connect the upper positioning block 61 and the lower positioning block 62.

Figure 6:
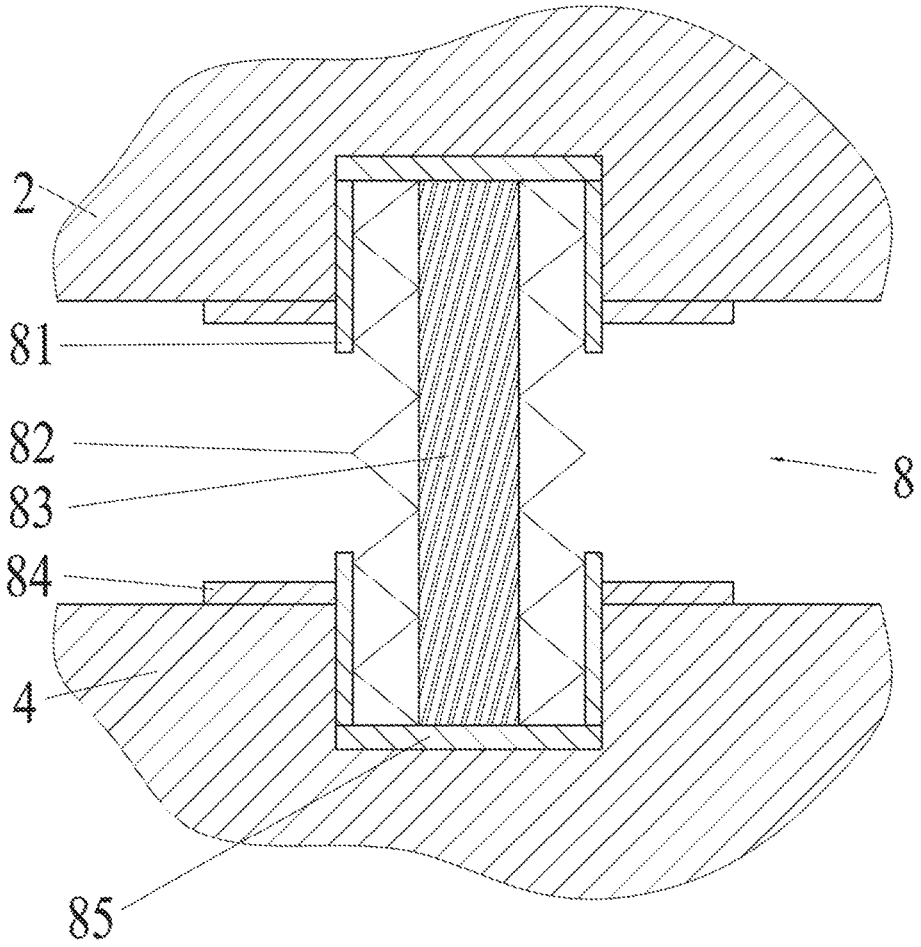
FIG. 6 is a schematic diagram of connections between a butterfly-shaped spring component and an upper bearing plate and a lower bearing plate.

As shown in FIG. 6, several butterfly-shaped spring components 8 used to bear bridge load, reduce rigidity of the bearing, prolong an earthquake period of a great earthquake, and provide restoration force and damping during the earthquake are distributed outside the hyperbolic spheroid 7 and between the upper bearing plate 2 and the lower bearing plate 4. The butterfly-shaped spring component 8 includes a bushing 81, a butterfly-shaped spring 82, a mild steel core 83, and a button-shaped snap ring 84, blind holes 86 are provided on the opposite surfaces of both the upper bearing plate 2 and the lower bearing plate 4, a bushing 81 matching the blinding hole 86 is disposed in each blind hole 86, a rear bearing cushion 85 is disposed at a bottom of each blind hole 86, the butterfly-shaped spring 82 is disposed between two bushings 81, the mild steel core 83 is disposed in an axial direction in a center of the butterfly-shaped spring 82, the button-shaped snap ring 84 is disposed at a hole edge of the blind hole 86, one end of the bushing 81 extends out of the blind hole 86, and the button-shaped snap ring 84 is snapped onto the end of the bushing 81.

As shown in FIG. 4 and FIG. 5, several bearing limiting structures 9 used to bear bridge load, limit excessive displacement and rotation of the upper bearing plate 2 and the lower bearing plate 4 in the horizontal direction and vertical direction are distributed outside the hyperbolic spheroid 7 and between the upper bearing plate 2 and the lower bearing plate 4. The bearing limiting structure 9 includes an external limiting block 91 and an internal limiting block 92, the external limiting block 91 is fixed on the upper bearing plate 2, the internal limiting block 92 is fixed on the lower bearing plate 4, the external limiting block 91 and the internal limiting block 92 are snapped onto each other, and a gap exists between the external limiting block 91 and the internal limiting block 92.

A design concept and an operating principle of the present invention under various working conditions are as follows:

Under normal working conditions, the bearing in the present invention bears the whole bridge by using the hyperbolic spheroid 7, the bearing positioning structure 6, and the bearing limiting structure 9, and a long-term non-linear effect caused by factors such as a temperature effect cycle and braking force is overcome by using the sliding groove type structure formed by the upper connecting steel plate 1 and the upper bearing plate 2, and the sliding groove type structure formed by the lower connecting steel plate 5 and the lower bearing plate 4.

Under low-magnitude seismic working conditions, the anti-shearing bolt on the bearing positioning structure 6 of the bearing in the present invention is cut off, and the hyperbolic spheroid 7, the upper bearing plate 2, and the lower bearing plate 4 together consume massive seismic energy depending on the upper spherical sliding friction pair and the lower spherical sliding friction pair formed by the hyperbolic spheroid 7, the upper bearing plate 2, and the lower bearing plate 4. In addition, the hyperbolic spheroid 7 may be further used to implement repetitive conversion between kinetic energy and potential energy and consume seismic energy. In addition, under such working conditions, the butterfly-shaped spring component 8 and the hysteretic damping component 3 enter a resilient deformation stage and absorb seismic energy.

Under high-magnitude seismic working conditions, the hysteretic damping component 3 of the bearing in the present invention has great resilient deformation, and the butterfly-shaped spring component 8 has greater resilient deformation under action of external force. Under worse working conditions, the shearing bolt connected to the hysteretic damping component 3 is cut off, the hysteretic damping component 3 has resilient deformation and even the shearing bolt is cut off, the butterfly-shaped spring 82 has resilient deformation, and the hyperbolic spheroid friction pair and the sliding groove type structure together absorb and consume seismic energy under such working conditions. Under extreme conditions, depending on the bearing limiting structure 9 and the sliding groove type structure, the present invention prevents excessive displacement and rotation of various components of the bearing, further prevents breaking of the bearing and prevents bridge falling, ensures that a major disaster such as bridge falling does not occur under seismic working conditions, and ensures timely and fast repair of the bridge after the earthquake.

In the present invention, the foregoing structures may be properly designed and selected according to structural characteristics of buildings and bridges and local geological conditions.

The foregoing descriptions are merely preferred implementations of the present invention. It should be understood that, the present invention is not limited to the forms disclosed in the specification. Exclusion of other embodiments should not be considered. Various other combinations, modifications, and environments may also apply, and modifications can be made within the scope of the idea in the specification through the foregoing teaching and technology or knowledge in the related field. The modifications and variations made by a person skilled in the art without departing from the spirit and scope of the present invention shall fall within the protection scope the appended claims of the present invention.

What is claimed is:

1. A sliding groove type friction pendulum high-pier bridge seismic mitigation and isolation bearing, comprising:

an upper connecting steel plate (1), a lower connecting steel plate (5), and a frictional sliding component clamped between the upper connecting steel plate (1) and the lower connecting steel plate (5);

wherein a plurality of parallel protrusions are disposed on opposite surfaces of the upper connecting steel plate (1) and the lower connecting steel plate (5), and the protrusions on the upper connecting steel plate (1) are vertical to the protrusions on the lower connecting steel plate (5);

the frictional sliding component comprises an upper bearing plate (2), a lower bearing plate (4), and a hyperbolic spheroid (7), the upper bearing plate (2) is disposed on a lower surface of the upper connecting steel plate (1), the lower bearing plate (4) is disposed on an upper surface of the lower connecting steel plate (5), grooves matching corresponding protrusions are provided on both the upper bearing plate (2) and the lower bearing plate (4), and the hyperbolic spheroid (7) is located between the upper bearing plate (2) and the lower bearing plate (4) and cooperates with the upper bearing plate (2) and the lower bearing plate (4) based on sliding of a spherical sliding friction pair; and a plurality of hysteretic damping components (3), a plurality of bearing positioning structures (6), a plurality of butterfly-shaped spring components (8), and a plurality of bearing limiting structures (9) are disposed on opposite surfaces of the upper bearing plate (2) and the lower bearing plate (4) in a circumferential direction.

2. The sliding groove type friction pendulum high-pier bridge seismic mitigation and isolation bearing according to claim 1, wherein the hysteretic damping component (3) comprises two hysteretic dampers (31), the hysteretic damper (31) comprises a U-shaped frame and an oblique frame, the U-shaped frame is located in a horizontal plane, a slot bottom of the U-shaped frame is fixedly connected to one end of the oblique frame, the oblique frame is located in a vertical plane and disposed obliquely, oblique frames of the two hysteretic dampers (31) overlap and clasp each other, and slot openings of the U-shaped frames of the two hysteretic dampers (31) are respectively located in an upper position and a lower position.

3. The sliding groove type friction pendulum high-pier bridge seismic mitigation and isolation bearing according to claim 2, wherein the bearing positioning structure (6) comprises an upper positioning block (61) and a lower positioning block (62), the upper positioning block (61) is fixed on the upper bearing plate (2), the lower positioning block (62) is fixed on the lower bearing plate (4), slotted holes are provided in a horizontal direction in middle positions in the upper positioning block (61) and the lower positioning block (62), and a shearing bolt is disposed in the slotted hole to connect the upper positioning block (61) and the lower positioning block (62).

4. The sliding groove type friction pendulum high-pier bridge seismic mitigation and isolation bearing according to claim 3, wherein the butterfly-shaped spring component (8) comprises a bushing (81), a butterfly-shaped spring (82), a mild steel core (83), and a button-shaped snap ring (84), blind holes (86) are provided on the opposite surfaces of both the upper bearing plate (2) and the lower bearing plate (4), a bushing (81) matching the blinding hole is disposed in each blind hole (86), a rear bearing cushion (85) is disposed at a bottom of each blind hole (86), the butterfly-shaped spring (82) is disposed between two bushings (81), the mild steel core (83) is disposed in an axial direction in a center of the butterfly-shaped spring (82), the button-shaped snap ring (84) is disposed at a hole edge of the blind hole (86), one end of the bushing (81) extends out of the blind hole (86), and the button-shaped snap ring (84) is snapped onto the end of the bushing (81).

5. The sliding groove type friction pendulum high-pier bridge seismic mitigation and isolation bearing according to claim 4, wherein the bearing limiting structure (9) comprises an external limiting block (91) and an internal limiting block (92), the external limiting block (91) is fixed on the upper bearing plate (2), the internal limiting block (92) is fixed on the lower bearing plate (4), the external limiting block (91) and the internal limiting block (92) are snapped onto each other, and a gap exists between the external limiting block (91) and the internal limiting block (92).

6. The sliding groove type friction pendulum high-pier bridge seismic mitigation and isolation bearing according to claim 1, wherein the protrusions and the grooves have gaps in vertical and horizontal directions thereof, sizes of the gaps are different, and vertical gaps of the protrusions are greater than horizontal gaps.

7. The sliding groove type friction pendulum high-pier bridge seismic mitigation and isolation bearing according to claim 6, wherein shapes of cross-sections of the protrusions on the upper connecting steel plate (1) and the lower connecting steel plate (5) in vertical planes are semi-circle arc shapes, semi-ellipse arc shapes, semi-triangle shapes, semi-rectangle shapes, semi-polygon shapes, or semi-non-polygon shapes.

8. The sliding groove type friction pendulum high-pier bridge seismic mitigation and isolation bearing according to claim 1, wherein the upper connecting steel plate (1) is connected to a bridge by using an upper anchor pullout resistance component formed by a plurality of pillars, the lower connecting steel plate (5) is connected to a pier by using a lower anchor pullout resistance component formed by a plurality of pillars, a shape of a bottom of the anchor pullout resistance component is a pillar shape, and a periphery of the pillar shape is a groove or inverted tooth structure.

9. The sliding groove type friction pendulum high-pier bridge seismic mitigation and isolation bearing according to claim 1, wherein a quantity of the hysteretic damping components (3) is two, a quantity of the bearing positioning structures (6) is two, a quantity of the butterfly-shaped spring components (8) is two, and a quantity of the bearing limiting structures (9) is two.

10. The sliding groove type friction pendulum high-pier bridge seismic mitigation and isolation bearing according to claim 1, wherein the spherical friction pair comprises a spherical non-metal sliding plate and a spherical stainless steel plate, and the spherical non-metal sliding plate and the spherical stainless steel sliding plate are combined into the spherical friction pair.

* * * * *